US007531022B2

(12) United States Patent
Quirmbach et al.

(10) Patent No.: US 7,531,022 B2
(45) Date of Patent: May 12, 2009

(54) LIQUID AND ITS USE FOR THE PREPARATION OF HARD METALS

(75) Inventors: Peter Quirmbach, Hundsdorf (DE); Michael Hölzgen, Ebernhahn (DE); Alfred Vuin, Wiesbaden (DE)

(73) Assignee: Zschimmer & Schwarz GmbH & Co. KG Chemische Fabriken (DE)

( * ) Notice: Subject to any disclaimer, the term of this patent is extended or adjusted under 35 U.S.C. 154(b) by 181 days.

(21) Appl. No.: 11/249,876

(22) Filed: Oct. 13, 2005

(65) Prior Publication Data

US 2006/0091579 A1 May 4, 2006

(30) Foreign Application Priority Data

Nov. 4, 2004 (DE) ..... 10 2004 053 221

(51) Int. Cl.
*B22F 1/00* (2006.01)
*B29B 9/00* (2006.01)
*C22C 1/05* (2006.01)

(52) U.S. Cl. ..... 75/355; 75/239; 75/240; 75/252; 75/255; 75/330; 75/354; 75/392; 106/14.13; 106/14.15; 106/14.34; 106/14.35; 106/14.37; 106/14.41; 106/14.42; 106/14.44; 106/287.18; 264/109

(58) Field of Classification Search ..... 106/14.13, 106/14.15, 14.34, 14.35, 14.37, 14.41, 14.42, 106/14.44, 287.18; 75/252, 255, 330, 354, 75/355, 392; 264/109
See application file for complete search history.

(56) References Cited

U.S. PATENT DOCUMENTS

| | | | | |
|---|---|---|---|---|
| 4,098,720 | A | 7/1978 | Hwa | 252/389 |
| 4,245,993 | A * | 1/1981 | Kirner et al. | 8/664 |
| 4,315,889 | A | 2/1982 | McChesney et al. | 422/7 |
| 4,397,889 | A * | 8/1983 | Benjamin et al. | 427/221 |
| 5,589,106 | A | 12/1996 | Shim et al. | 252/387 |
| 5,590,387 | A | 12/1996 | Schmidt et al. | 419/36 |
| 5,739,195 | A * | 4/1998 | Kroker et al. | 524/459 |
| 5,922,978 | A | 7/1999 | Carroll | 75/240 |
| 6,039,784 | A | 3/2000 | Luk | 75/231 |
| 6,153,179 | A * | 11/2000 | Blankenburg et al. | 424/70.11 |
| 6,261,336 | B1 | 7/2001 | Behi et al. | 75/246 |
| 6,277,448 | B2 * | 8/2001 | Strutt et al. | 427/452 |
| 6,579,573 | B2 * | 6/2003 | Strutt et al. | 427/452 |
| 2003/0061906 | A1 * | 4/2003 | Knunz et al. | 75/252 |
| 2003/0075012 | A1 | 4/2003 | Knunz et al. | 75/228 |
| 2003/0077398 | A1 * | 4/2003 | Strutt et al. | 427/452 |
| 2004/0132902 | A1 * | 7/2004 | Bremser et al. | 524/800 |
| 2006/0180793 | A1 * | 8/2006 | Wenderoth et al. | 252/387 |
| 2006/0219056 | A1 * | 10/2006 | Larink, Jr. | 75/338 |

FOREIGN PATENT DOCUMENTS

| | | | |
|---|---|---|---|
| DE | 2514128 | A1 * | 10/1976 |
| DE | 4338122 | A1 | 5/1995 |
| DE | 69223940 | T | 7/1998 |
| EP | 0471123 | A1 | 2/1992 |
| EP | 1 375 035 | A1 | 1/2004 |
| GB | 2081733 | A | 2/1982 |
| GB | 2133047 | A * | 7/1984 |
| JP | 56-99265 | A * | 8/1981 |
| JP | 63-8465 | A * | 1/1988 |
| JP | 5-112753 | A * | 5/1993 |
| WO | WO2004/009858 | | 1/2004 |
| WO | WO 2004/009858 | | 1/2004 |

OTHER PUBLICATIONS

Derwent-Acc-No: 2004-341168A, abstract of Chinese Patent Specification No. CN1453244A (Nov. 5, 2003).*
European Search Report for European Patent Application No. 05 01 8858, Feb. 9, 2006.
European Search Report for European Patent Application No. 05 01 8859.8, Feb. 9, 2006.

* cited by examiner

*Primary Examiner*—Anthony J Green
(74) *Attorney, Agent, or Firm*—Kusner & Jaffe

(57) ABSTRACT

A liquid for the preparation of powder mixtures on the basis of hard metals, comprising water and an inhibitor, wherein the inhibitor is in the form of at least one of the following materials: polyvinyllactam or wax emulsion, or the inhibitor is in the form of at least one of the following materials: carboxylic acid, amines or their derivatives.

11 Claims, No Drawings

LIQUID AND ITS USE FOR THE PREPARATION OF HARD METALS

The invention relates to the composition of a liquid as well as its use for the preparation of powder mixtures based on hard metals.

For the preparation of highly stressed products, for example highly stressed tools such as cutting tools, sintered materials based on hard metals are generally employed.

As hard metals above all the carbides of titanium, tantalum and niobium (TiC, TaC, NbC), but also especially tungsten monocarbide (WC) are employed.

For the manufacture of materials based on hard metals, for example based on WC, hard metal or WC powder are prepared with other metal powders especially cobalt powder as a powder mixture, the prepared powder mixture pressed by pressing into molded parts, and subsequently by sintering the molded parts below the melting temperature of the hard metal, sintered to the desired product.

So far that in the following the preparation of WC/Co powder mixtures is influenced, the operations are valid for other powder mixtures based on hard metals.

The mixing of cobalt powder together with WC powder is necessary in order to improve the sintering properties of the molded part. The sintering of a molded part from pure WC powder is not possible.

In the preparation, the intimate mixture of the WC powder with the Co powder stands in the forefront. In the mixture of WC powder and of the cobalt powder demixing is a consideration due to the different densities of the two powders. For the manufacture of the most homogeneous and hardest materials from the hard metal the most homogeneous powder mixture possible must however be present.

The WC/Co powder mixture is therefore mixed with the aid of liquids. This mixing process in a liquid is nowadays generally carried out in so-called attritors, a type of ball mill to which together with the WC/Co powder mixture to be mixed, milling balls, liquid and paraffin are added. The mixing of the powder in the attritors represents a combination of a mixing and a milling process, so that the liquid, with whose aid the powder mixture is mixed in the attritor, is also designated as a milling liquid.

In the mixture or milling in the attritor the WC powder particles are reduced in size as well as at the same time being mixed with cobalt powder particles.

As liquids, or milling liquids, generally organic liquids, also in particular alcohols, like for example hexane, heptane, ethyl alcohol or acetone are used.

In the mixing/milling process in the attritor, the paraffin dissolved in the organic liquid deposits around the WC and Co particles and thereby is effective in the later pressing process as a pressing aid among other things.

The use of an aqueous liquid as milling liquid has so far been generally out of the question, since the WC particles were partly hydrolyzed in an aqueous liquid or milling liquid and the properties of the product manufactured from it was affected disadvantageously through this.

Furthermore the use of an aqueous milling liquid came to be out of the question since the paraffin that was generally present in the milling liquid was only soluble in organic liquids but not in water.

The use of organic, in particular also alcoholic milling liquids is however associated with numerous disadvantages. Thus the attritors as well also as the attritors' downstream process drying plants, particularly for example the spraying drying systems, had to be encapsulated expnexively, in order to prevent leakage of the flammable and explosive organic liquids out of the plants.

Furthermore, the higher materials costs of the organic milling liquids are disadvantageous as well as the higher costs of their disposal or as the case may be pollution control.

Moreover the technology applied up until now for the preparation of hard metals is disadvantageous in that the mix or milling process in the attritor lasts an extremely long time, generally between 6 and 36 hours.

The invention has the basic task of demonstrating a way, how instead of employing organic solvents as the mix-/mill liquid in the attritor for mixing and milling of powder mixtures based on hard metals, water can be used.

In accordance with the invention this task is solved by means of making available a liquid for the preparation of powder mixtures based on hard metals, containing water, inhibitor in the form of at least one of the following materials: polyvinyllactam, wax emulsion, and if necessary further materials Another solution is to make available a liquid for the preparation of powder mixtures based on hard metals, containing water, inhibitor in the form of at least one of the following materials: carboxylic acids, amines or their derivatives, and if necessary further materials The invention is based upon the knowledge that the milling liquid used in attritors in the form of an organic liquid can be replaced with water if the water has added to it a suitable inhibitor, which coats the hard metal particles and thereby prevents their hydrolysis.

In accordance with the invention it was recognized that polyvinyllactam or a wax emulsion or carboxylic acid, amines or their derivatives are suitable inhibitors.

The materials named above coat the hard metal powder particles as well as the other powder particles of the powder mixture, in particular then for example the Co powder particles or control the oxygen take-up onto the particles in such a way that these do not hydrolyze or scarcely at all or do not undergo any other reaction with the water.

The polyvinyllactam used can for example be a polyvinylcaprolactam. Alternatively or cumulatively the polyvinyllactam used can for example be a polyvinylpyrrolidone (PVP) or one or a plurality of its co- or ter-polymers, such as for example groups consisting of vinyl acetate, acrylate, methacrylate, acrylamide, methacrylamide, vinylimidazole, vniylcaprolactam, 3-mthyl-1-vinylimidazoniummethyl sulfate or other co- or terpolymers of polyvinylpyrrolidone. The copolymer proportion, related to the total weight of polyvinylpyrrolidone and one or a plurality of its co- or terpolymers, can vary over a range from 5 to 95 wt %. The polymers can for example have a molecular weight of 1,000 to 5,000,000 Daltons, preferably from 5,000 to 500,000 Daltons.

The wax emulsion can for example be a wax emulsion based on paraffin, oxidized paraffin, polyethylene, polypropylene, amide wax like e.g. ethylene-bis-stearylamide, stearates or mixtures thereof.

In accordance with the invention it was recognized that wax can only then be employed as inhibitor in a liquid or milling liquid of the type described herein if this is present as an emulsion in the liquid. The addition of wax in non-emulsified form does not lead to any distribution of wax in the water. In conformity with failed earlier investigations, to use water as a liquid for the preparation of hard metals since the non-emulsified paraffin is not distributed or coupled in the water.

The use of water as liquid for the preparation of hard metals or as milling or mixing liquid in the preparation of hard metals leads thereto that an expensive encapsulation of the preparation aggregate is no longer necessary. Further the water is essentially more favorable to supply than an organic liquid and its disposal is less wasteful.

At the same time it was determined that the mixing or milling process in the attritor clearly can be shortened to no more than about 1 to 3 hours. Finally by use of the liquid in accordance with the application, an improved mixing or milling process is observed.

Cumulatively or alternatively to the inhibitors already named (polyvinyllactam, wax emulsion) the liquid in accordance with the application can contain as inhibitor also especially carboxylic acids and/or amines or their particular derivatives. In particular carboxylic acid derivatives in the amine-neutralized state turn out to be particularly effective inhibitors.

As carboxylic acids preferably dicarboxylic acids and/or triazine derivatives can be employed. Dicarboxylic acids can in particular be for example 1,8-octanedicarboxylic acid, 1,9-nonane dicarboxylic acid, 1,10-decanedicarboxylic acid (sebacic acid), 1,11-undecanedicarboxylic acid, 1,12-dodecanecarboxylic acid and so forth up to including 1,16-hexadecanedicarboxylic acid. Relative to the triazine derivatives especially 1,3,5-triazine derivatives, above all 1,3,5-triazine-2,4,6-triaminetriacarboxylic acid are provided.

As amines, preferably ethanolamine and/or imidazolines are employed. Ethanolamines can for example in particular be triethanolamine, diethanolamine monoethanolamine and/or trishydroxymethylaminomethane. Relative to the imidazolines in addition to polymers containing imidazole units also non-polymeric imidazole derivatives, like for example 2-(2-heptadec-8-enyl-2-imidazoline-1-yl)ethanol are provided. Also similar imdidazo compounds can be provided to the latter, for example imidazoline derivatives, like for example hydroxyethyl, aminoethyl and/or amidoethyl-imdidazol derivatives. As alkyl groups oleic and talloleic fatty acids up to octanoic acid can be present.

It was determined in accordance with the invention that the above named inhibitors are particularly effective when they are present in combination with amines and carboxylic acids, in each case especially of the previously stated type.

As further materials in the liquid in accordance with the application, stabilizers (for example a cellulose) and/or dispersion agents (for example acrylic-based, such as polyacrylic acid) can be contained in the liquid.

The liquid in accordance with the application can be used for the preparation of powder mixtures based on hard metals, for example for the preparation of carbides of titanium, of tantalum, and of niobium. In particular the liquid in accordance with the application can be used for the preparation of hard metals based on tungsten monocarbide and here especially for the preparation of powder mixtures based on powders of tungsten monocarbide and cobalt.

After the preparation or the mixing of the hard metal or of the hard metal powder mixture in the attritor the moist powder mixture can be taken from the attritor and fed into a drying plant for example a spray drying installation.

In the drying plant for example a spray drying installation, the moist mixture is atomized to produce a granulate.

The granulate is transferred to a shaping unit, generally transferred to a press and is there pressed into a molded part.

It was established that the wax emulsion, in addition to its inhibitor property acts at the same time as an excellent pressing aid, whereby the homogeneity and green density or green solidity of the pressed molded part at the same molding pressure (in the comparison to the molding pressure or the properties of a molded part, which was prepared according to the prior art) is increased or a smaller molding pressure is required, in order to obtain the same properties with the molded part, which were obtained without use of a wax emulsion in the milling liquid.

The molded part is finally subjected to a heat treatment and is sintered thereby to the hard metal product.

The liquid in accordance with the application can for example be compounded as follows (the following data in wt %, unless stated otherwise relate to the total weight of the liquid):

water: 25-99 wt %, thus for example also 68-98 wt % or 85-95 wt %;

inhibitor: 1-75 wt %, thus for example also 2-32 wt % or 5-15 wt %;

other materials: 0-50 wt %.

Inhibitor in the form of polyvinyllactam can for example be present in the liquid in proportions from 0.5-50 wt % then for example also in proportions from 1-10 wt % or from 1-5 wt %.

Inhibitor in the form of a wax emulsion can for example be present in the liquid in proportions from 0.5-66 wt % then for example also in proportions from 1-25 wt % or from 2-15 wt %.

Carboxylic acid can for example be present in the liquid in proportions from 0.1 to 5 wt % then for example also in proportions from 0.5 to 4 wt %.

Amines can for example be present in the liquid in proportions from 0.1 to 7 wt % then for example also in proportions from 0.5 to 5 wt %.

Dispersion agents can for example be present in the liquid in proportions from 0.01 to 33 wt % then for example also in proportions from 0.1 to 5 wt % or from 0.5 to 3 wt %.

Stabilizers can for example be present in the liquid in proportions from 0.01 to 33 wt % then for example also in proportions from 0.05 to 6 wt % or from 0.1 to 3 wt %.

The liquid in accordance with the application can for example be mixed with 3 to 5 times the amount of WC/Co powder particles to the moist mixture.

In the following three examples are presented of compositions for a liquid in accordance with the application:

EXAMPLE 1 water: 88.9 wt %;

inhibitor in the form of poyvinylpyrrolidone, 2,000 kDalton: 2.2 wt % inhibitor in the form of a 50% paraffin emulsion: 8.9 wt %.

EXAMPLE 2 water: 88.5 wt %;

inhibitor in the form of polyvinylcaprolactam, 100 kDalton: 2.2 wt %;

inhibitor in the form of a 50% ethylene-bis-stearoylamide emulsion: 8.8 wt %;

stabilizer in the form of methylcellulose: 0.4 wt %.

EXAMPLE 3 water 87.7 wt %;

inhibitor in the form of vinylpyrrolidone/vinylimidazol copolymer 70k Dalton: 2.2 wt %;

inhibitor in the form of 50% polyethylene emulsion: 8.8 wt %;

dispersion agent in the form of polyammonium acrylate: 0.9 wt %;

stabilizer in the form of methylhydroxypropylcellulose: 0.4 wt %.

EXAMPLE 4 water 88.2 wt %;

inhibitor in the form of a 50% polyethylene emulsion: 7.6 wt %;

carboxylic acid in the form of 1.10-decanecarboxylic acid: 2.1 wt %;

amine in the form of triethanolamine: 2.1 wt %.

In the moist powder mixture of the liquid in accordance with the application and the WC/Co powder mixture in addition to 100 wt % WC and Co particles the following additional parts can for example be present with the components of the liquid:

10-200 wt % then for example also 15-70 or 15-40 wt % water, preferably deionized water, and 0.01-30 wt % then for example also 0.1-20 or 1-7 wt % inhibitor in the form of polyvinyllactam and/or wax emulsion;

0-10 wt % other materials.

Beside the 100 wt % WC and Co particles, inhibitor in the form of polyvinyllactam can be present additionally in an amount of 0.01-10 wt % thus for example also with 0,1-2 wt % in the moist mixture. Beside the 100 wt % WC and Co particles, inhibitor in the form of wax emulsion at 0.1-20 wt %, then also for example also 1-5 wt % can additionally be present in the moist mixture.

Beside the 100 wt % WC and Co particles and the previously named components in the moist mixture for example 0.01-5 wt % then for example also 0.1-0.8 wt % dispersing agent and/or for example 0.01-5 wt % then for example also 0.05-0.5 wt % stabilizer can be present in the moist mixture.

The invention claimed is:

1. A method of using a liquid in the preparation of powder mixtures on the basis of hard metals, said method comprising the steps of:

a. providing a milling liquid comprised of water and an inhibitor, said inhibitor being a polyvinyllactam or a mixture of a polyvinyllactam and a wax emulsion;

b. providing a powdered metal comprised of at least one hard metal;

c. combining said liquid with said powdered metal in an attritor to form a moist powder mixture; and d. atomizing said moist powder mixture in a spray drying installation to produce a powder mixture.

2. A method of using a liquid as defined in claim 1, wherein said polyvinyllactam is a polyvinylcaprolactam.

3. A method of using a liquid as defined in claim 1, wherein said polyvinyllactam is a polyvinylpyrrolidone or one of its co- or terpolymers.

4. A method of using a liquid as defined in claim 1, wherein said wax emulsion is a paraffin, a oxidized paraffin, a polyethylene, a polypropylene, an ethylene-bis-stearylamide, a stearylamide, a stearate or a mixture thereof.

5. A method of using a liquid as defined in claim 1, wherein said liquid is further comprised of at least one of a dispersion agent or a stabilizer.

6. A method of using a liquid as defined in claim 5, wherein said dispersion agent is a polyacrylic acid,

7. A method of using a liquid as defined in claim 1, wherein said powdered metal includes tungsten monocarbide.

8. A method of using a liquid in the preparation of powder mixtures on the basis of hard metals, said method comprising the steps of:

a. providing a milling liquid comprised of water and an inhibitor being at least one of a carboxylic acid, an amine, a derivative of a carboxylic acid or a derivative of an amine;

b. providing a powdered metal comprised of at least one hard metal;

c. combining said liquid with said powdered metal in an attritor to form a moist powder mixture; and d. atomizing said moist powder mixture in a spray drying installation to produce a powder mixture.

9. A method of using a liquid as defined in claim 8, wherein said liquid is further comprised of at least one of a dispersion agent or a stabilizer.

10. A method of using a liquid as defined in claim 9, wherein said dispersion agent is a polyacrylic acid.

11. A method of using a liquid as defined in claim 8, wherein said powdered metal includes tungsten monocarbide.

* * * * *